US012239873B2

(12) United States Patent
Rees et al.

(10) Patent No.: US 12,239,873 B2
(45) Date of Patent: Mar. 4, 2025

(54) WEIGHT ELEVATION SYSTEMS, METHODS, AND DEVICES

(71) Applicants: Cody D. Rees, Ashburn, VA (US); Wyatt P. Rees, Ashburn, VA (US)

(72) Inventors: Cody D. Rees, Ashburn, VA (US); Wyatt P. Rees, Ashburn, VA (US)

( * ) Notice: Subject to any disclaimer, the term of this patent is extended or adjusted under 35 U.S.C. 154(b) by 314 days.

(21) Appl. No.: 18/090,483

(22) Filed: Dec. 29, 2022

(65) Prior Publication Data

US 2023/0241446 A1 Aug. 3, 2023

Related U.S. Application Data

(60) Provisional application No. 63/304,515, filed on Jan. 28, 2022.

(51) Int. Cl.
*A63B 21/078* (2006.01)
*A63B 21/00* (2006.01)
*A63B 24/00* (2006.01)

(52) U.S. Cl.
CPC ..... *A63B 21/0783* (2015.10); *A63B 21/4029* (2015.10); *A63B 24/0087* (2013.01)

(58) Field of Classification Search
CPC ..... A63B 21/0783; A63B 21/4029; A63B 24/0087; A63B 2071/0677; A63B 2071/068; A63B 2071/0683; A63B 2220/52; A63B 2225/50; A63B 2230/208
See application file for complete search history.

(56) References Cited

U.S. PATENT DOCUMENTS

| | | | | |
|---|---|---|---|---|
| 4,602,785 | A * | 7/1986 | Rockwell | A63B 21/078 482/104 |
| 5,151,072 | A * | 9/1992 | Cone | A63B 21/078 482/104 |
| 5,281,193 | A * | 1/1994 | Colbo, Jr. | A63B 21/078 482/142 |
| 5,509,876 | A * | 4/1996 | Reyes | A63B 21/078 482/104 |
| 6,689,027 | B1 * | 2/2004 | Gardikis, Jr. | A63B 21/078 482/142 |
| 8,740,760 | B2 * | 6/2014 | York | A63B 21/078 482/104 |
| 8,834,329 | B2 * | 9/2014 | Kelly | A63B 21/0724 482/106 |
| 9,248,335 | B2 * | 2/2016 | Reyes | A63B 21/078 |
| 10,561,882 | B2 * | 2/2020 | Baek | A63B 17/04 |
| 10,646,740 | B2 * | 5/2020 | Lee | A63B 21/0724 |
| 11,406,862 | B2 * | 8/2022 | Downing | A63B 21/078 |
| 2007/0203003 | A1 * | 8/2007 | Brawner | A63B 21/4029 482/104 |
| 2008/0004165 | A1 * | 1/2008 | Brawner | A63B 21/0783 482/104 |
| 2014/0296040 | A1 * | 10/2014 | Mobley | A63B 21/00181 482/104 |
| 2018/0318635 | A1 * | 11/2018 | Lee | A63B 24/0087 |

* cited by examiner

*Primary Examiner* — Joshua Lee
(74) *Attorney, Agent, or Firm* — Outer Space IP

(57) ABSTRACT

Systems, devices, and methods for elevating weights are disclosed. A lifting bar rotates about a rotating joint attached to a vertical support. As the system is engaged, the lifting rotates from a downward position parallel to the vertical support to a horizontal position, a hook on the lifting bar engaging the weight and lifting it.

20 Claims, 10 Drawing Sheets

WEIGHT ELEVATION SYSTEMS, METHODS, AND DEVICES

CROSS-REFERENCE TO RELATED APPLICATIONS

This application claims the benefit of U.S. Provisional Patent Application No. 63/304,515 filed 28 Jan. 2022, which is incorporated by reference herein in its entirety.

TECHNICAL FIELD

The present disclosure relates generally to devices, systems, and methods for exercise personal protection. More particularly, the present disclosure relates to devices, systems, and methods for protecting weightlifting users.

BACKGROUND

Exercise is an important aspect of human health. One of these is weightlifting. However, lifting weights often requires the use of spotters, for safety, as an individual can easily attempt to lift more weight than they are capable, or to lift the weight too many times, leaving them fatigued and unable to lift the weight. This can lead to injury or even death. A solo weightlifter requires a spotter, even when a human spotter is unavailable.

SUMMARY

In a first aspect, the disclosure provides a system for elevating a weight. A vertical support consists of a first slot configured to engage a rotating joint and a latch configured to hold a latch pin. A latch release mechanism is configured to release the latch pin from the latch. A rotating joint rotatably attaches a lifting bar to the vertical support. The lifting bar consists of a hook configured to capture and hold the weight when the rotating joint moves the lifting bar to a horizontal position, perpendicular to the vertical support, a lock pin configured to engage the vertical support when the rotating joint moves the lifting bar to the horizontal position, a latch pin configured to engage the latch when the rotating joint lowers the lifting bar to a parallel position with the vertical support, and a second slot configured to engage the rotating joint. An angular momentum imparting device is configured to continuously impart a torque to rotate the lifting bar towards the horizontal position. The lifting bar is rotated downward by a user to engage the latch pin with the latch, thereby latching the lifting bar down. The latch is released by the latch release mechanism, allowing the angular momentum imparting device to rotate the lifting bar to the horizontal, the hook engaging and lifting the weight. The lock pin engages and locks the lifting bar in the horizontal position.

In a second aspect, the disclosure provides a method for elevating a weight. A lifting bar including a hook, a lock pin, and a latch pin is provided. A vertical support including a latch is provided. The lifting bar is rotatably attached to the vertical support. An angular momentum imparting device is provided that imparts a torque to rotate the lifting bar towards a horizontal position. The lifting bar is locked downward, parallel to the vertical support and below the weight, by engaging the latch pin into the latch. The latch is released by engaging a latch release mechanism, causing the lifting bar to rotate to the horizontal position, the hook to engage the weight, the lifting bar to elevate the weight, and the lock pin to engage the lifting bar in the horizontal position.

In a third aspect, the disclosure provides a system for elevating a weight. A vertical support with a first slot configured to engage a rotating joint. A lifting bar with a hook configured to capture and hold the weight when the rotating joint moves the lifting bar to a horizontal position, perpendicular to the vertical support, and a second slot configured to engage the rotating joint. The rotating joint configured to allow the lifting bar to rotate versus the vertical support. A motor configured to rotate the lifting bar downward when the motor receives instructions from the user and to impart angular momentum to rotate the bar to the horizontal position when a safety switch engages. As the safety switch engages the motor rotates the bar to the horizontal position, the hook engaging and lifting the weight.

Further aspects and embodiments are provided in the foregoing drawings, detailed description and claims.

BRIEF DESCRIPTION OF THE DRAWINGS

The following drawings are provided to illustrate certain embodiments described herein. The drawings are merely illustrative and are not intended to limit the scope of claimed inventions and are not intended to show every potential feature or embodiment of the claimed inventions. The drawings are not necessarily drawn to scale; in some instances, certain elements of the drawing may be enlarged with respect to other elements of the drawing for purposes of illustration.

DETAILED DESCRIPTION

Figure 1:
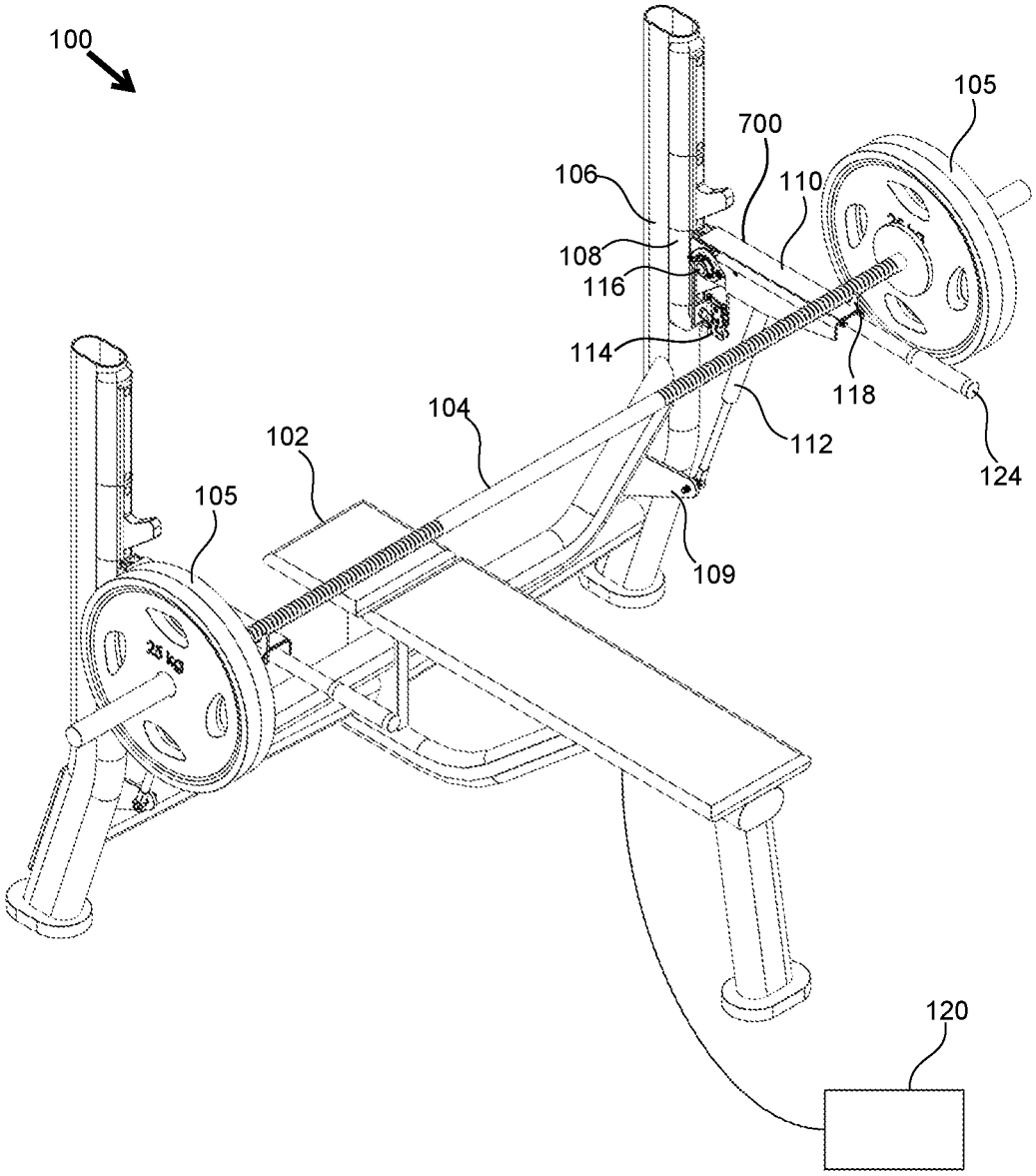
FIG. 1 is an elevated isometric drawing showing a bench press with a barbell with an automatic spotting system engaged and holding the barbell.

The following description recites various aspects and embodiments of the inventions disclosed herein. No particular embodiment is intended to define the scope of the invention. Rather, the embodiments provide non-limiting examples of various compositions, and methods that are included within the scope of the claimed inventions. The description is to be read from the perspective of one of ordinary skill in the art. Therefore, information that is well known to the ordinarily skilled artisan is not necessarily included.

Definitions

The following terms and phrases have the meanings indicated below, unless otherwise provided herein. This disclosure may employ other terms and phrases not expressly defined herein. Such other terms and phrases shall have the meanings that they would possess within the context of this disclosure to those of ordinary skill in the art. In some instances, a term or phrase may be defined in the singular or plural. In such instances, it is understood that any term in the singular may include its plural counterpart and vice versa, unless expressly indicated to the contrary.

As used herein, the singular forms "a," "an," and "the" include plural referents unless the context clearly dictates otherwise. For example, reference to "a substituent" encompasses a single substituent as well as two or more substituents, and the like.

As used herein, "for example," "for instance," "such as," or "including" are meant to introduce examples that further clarify more general subject matter. Unless otherwise expressly indicated, such examples are provided only as an aid for understanding embodiments illustrated in the present disclosure and are not meant to be limiting in any fashion. Nor do these phrases indicate any kind of preference for the disclosed embodiment.

Bench pressing is dangerous and can lead to injuries in the event of an inability to lift the weight off oneself. Spotters (additional persons) should be present to help lift weight off the user, but spotters are often not around. Currently existing safety devices either impede a user's natural movement or require the purchase of an entirely new bench press built around the safety mechanism. Already existing bench presses, as well as other weight lifting apparatuses, would benefit from a safety device that can be an add on and will act as a spotter; actively lifting weight off a user only when needed.

In a preferred embodiment of the present invention, two lifting arms are attached to a bench press, one on each side of the user. These arms are normally in a closed position that keeps it out of the way of the user's motion and motion of the barbell/weights. When a user requires assistance in lifting the weight, they activate the arms by a foot pedal or other switch, as discussed below. The arms swing up, grabbing the weights as they raise up, and relieve the user. The arms lock in the upright position, allowing the user to stand up and remove the weights from the barbell. Once the weights are removed, the user can unlock the arms and use a handle to push the arms back to the passive/down position, where they will stay locked in place until activated.

Figure 2:
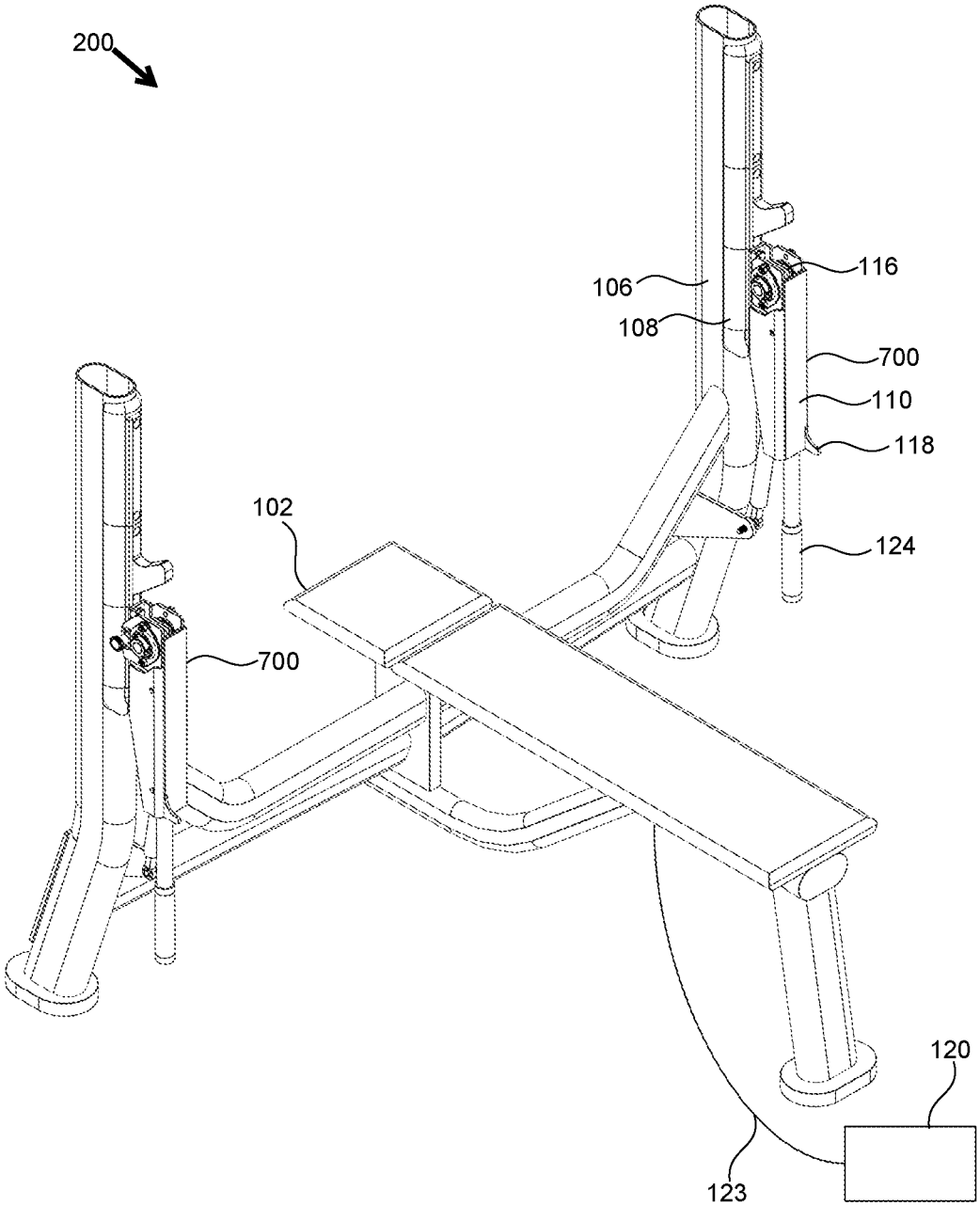
FIG. 2 is an elevated isometric drawing showing the bench press of FIG. 1 with the barbell removed and the automatic spotting system in the ready position.
Figure 3:
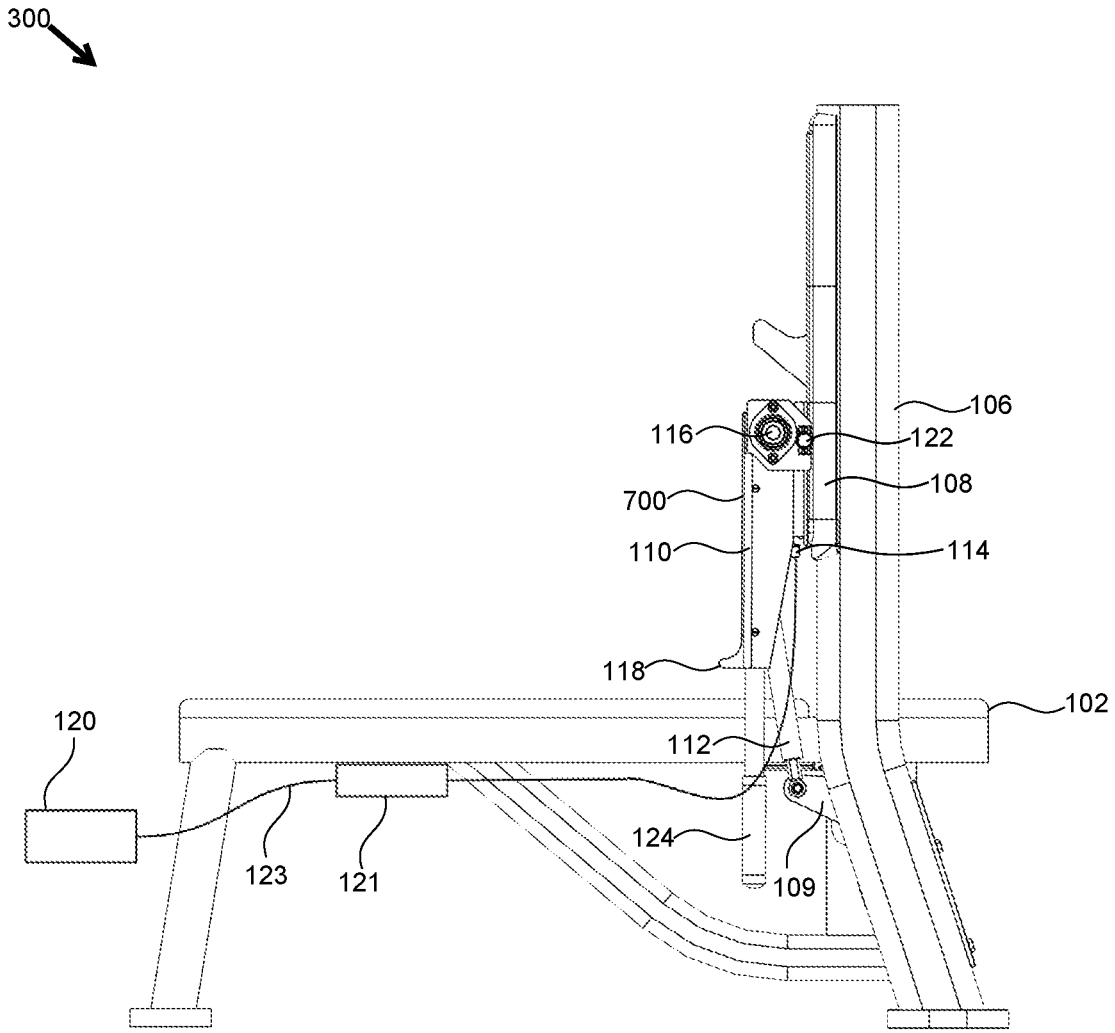
FIG. 3 is a side view drawing showing the bench press of FIG. 2.
Figure 4:
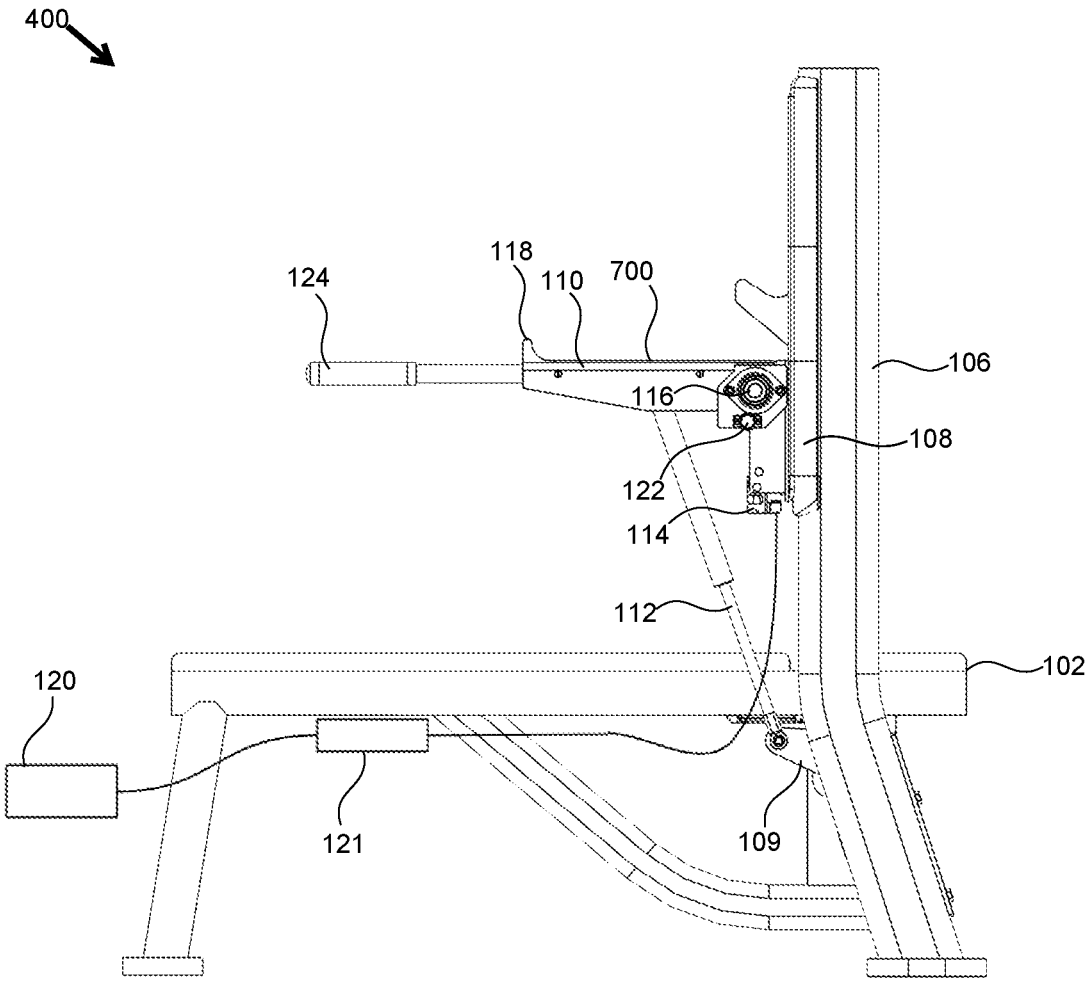
FIG. 4 is a side view drawing showing the bench press of FIG. 1, without the barbell.
Figure 5:
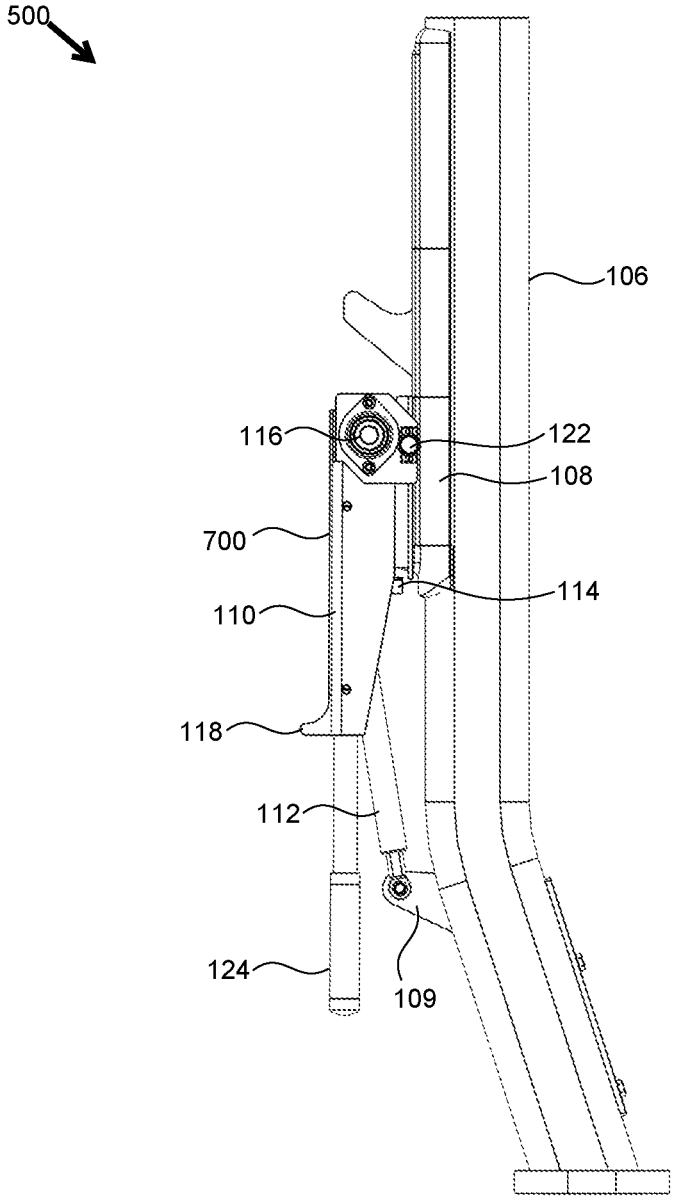
FIG. 5 is a side view drawing showing only the vertical leg of the bench press of FIG. 2 with the associated automatic spotting system in the ready position.
Figure 6:
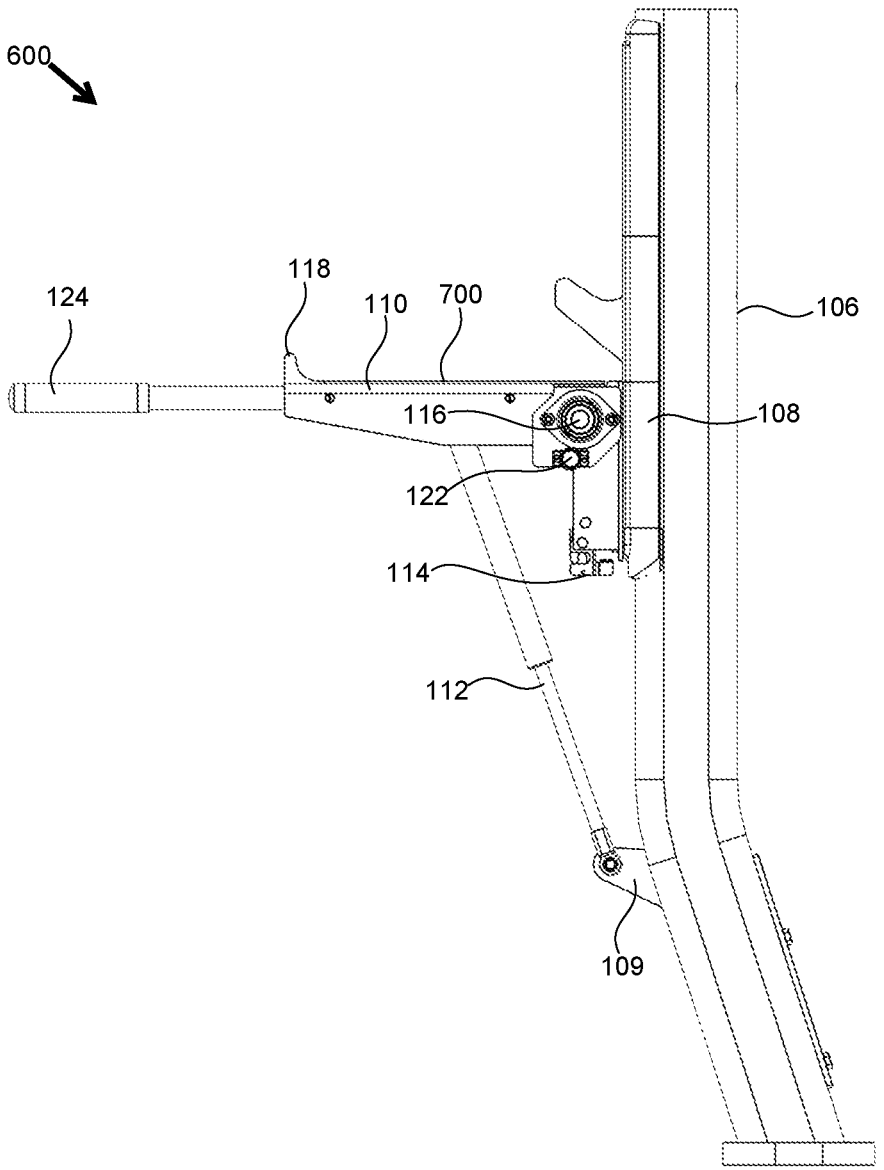
FIG. 6 is a side view drawing showing only the vertical leg of the bench press of FIG. 1 without the barbell with the associated automatic spotting system engaged.
Figure 7:
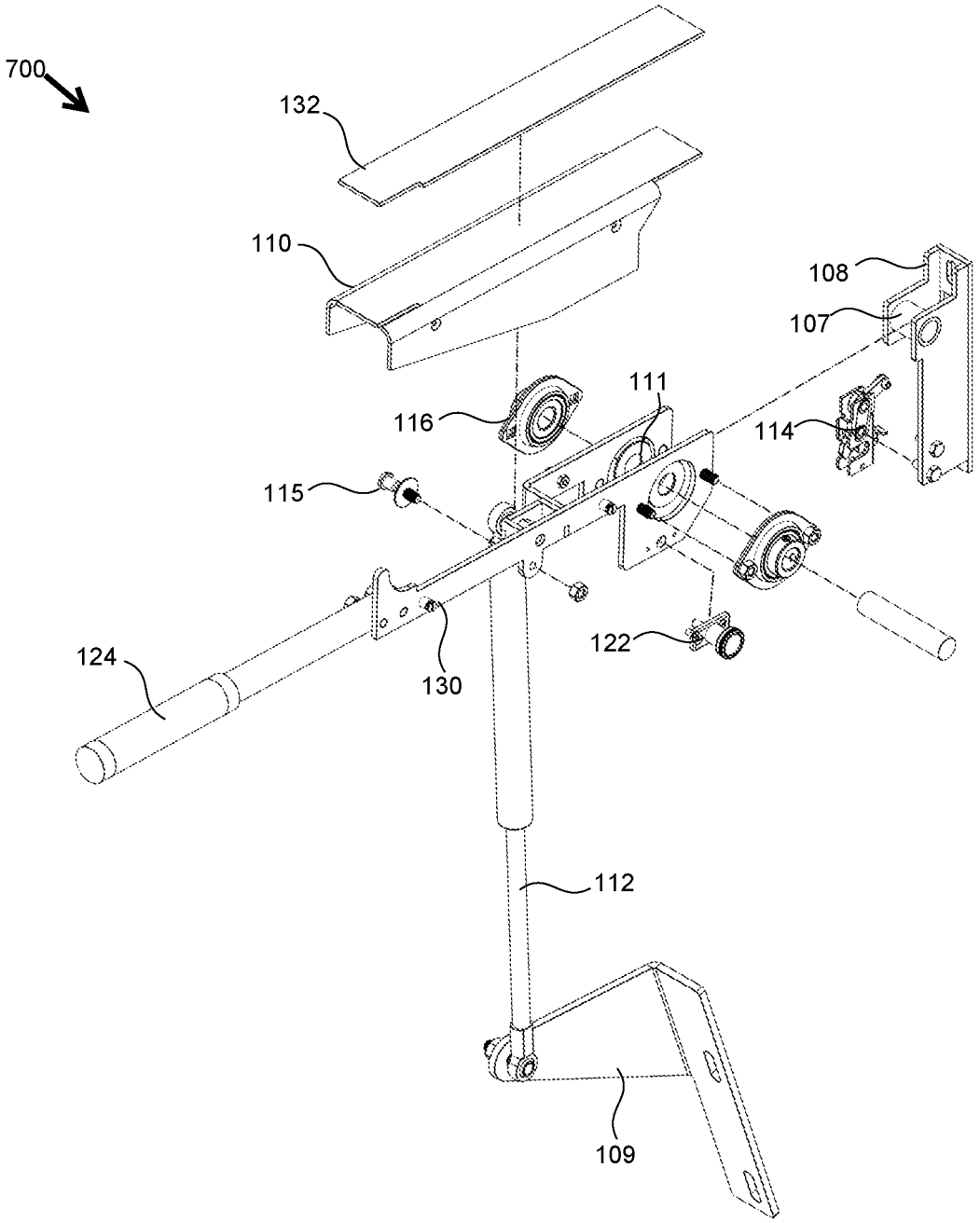
FIG. 7 is an exploded isometric view drawing showing the automatic spotting system of FIG. 1.

Now referring to the Figures, FIG. 1 is an elevated isometric drawing at 100 showing a bench press with a barbell with an automatic spotting system engaged and holding the barbell that may be used in one embodiment of the present invention. FIG. 2 is an elevated isometric drawing at 200 showing the bench press of FIG. 1 with the barbell removed and the automatic spotting system in the ready position. FIG. 3 is a side view drawing at 300 showing the bench press of FIG. 2. FIG. 4 is a side view drawing at 400 showing the bench press of FIG. 1, without the barbell. FIG. 5 is a side view drawing at 500 showing only the vertical leg of the bench press of FIG. 2 with the associated automatic spotting system in the ready position. FIG. 6 is a side view drawing at 600 showing only the vertical leg of the bench press of FIG. 1 without the barbell with the associated automatic spotting system engaged. FIGS. 1 through 6 are discussed below and all share common numbering as they are different views of the same system. FIG. 7 is an exploded isometric view drawing at 700 showing the automatic spotting system of FIG. 1. The automatic spotting system 700 consists of a vertical support 108, a lifting bar 130, a handle 124, a piston 112, and a piston-vertical mount 109. The latch actuating system 120 is not shown at 700 but is shown on several drawings. The vertical support 108 has a latch 114 and a slot 107 for a rotating joint 116. The lifting bar 130 has a hook 118, a cover 110 with padding 132, a latch pin 115, the rotating joint 116 that passes through a slot 111, and a locking pin 122. The vertical support 108 and the piston-vertical mount 109 attach to the bench press legs 106. In a preferred embodiment, this attachment is a refit of an existing bench press.

The bench press 102 is used by a user to lift barbell 104 carrying weight 105. As the user lifts barbell 104 with the automatic spotting system 700 in the ready position (as at 200 or 300, where the lifting bar 130 is parallel to the vertical support 108), the user engages actuating system 120 which sends a signal to splitter 121 via cable 123. The splitter 121 sends the signal onward to the latch release mechanisms 114, which disengage the latch pins 115. With the latch pins 115 disengaged, the lifting bars 130 are pushed upwards by applied torque from pistons 112 until the lifting bars 130 reach the horizontal position. (Lifting bars 130 are encased by covers 110 and so are not visible in FIGS. 1 through 6.) As the lifting bars 130 pass through the space occupied by the barbell 104, the hooks 118 catch the barbell 104 and lifts it with the lifting bars 130 to the horizontal, relieving the user of the weight of the barbell 104. As the lifting bars 130 reach the horizontal, the locking pins 122, a spring loaded pin, engages with the vertical supports 108, locking the lifting bars 130 in the horizontal and providing extra support for the barbell 104 above that of the pistons 112. The covers 110 and padding 132 provide a flat, padded surface for the barbell to rest on.

The automatic spotting system 700 is readied by a user disengaging the locking pins 122 and using the handle 124 to push the lifting bar 130 to a parallel position with the vertical support 108, until the latch pin 115 engages the latch 114.

Figure 8:
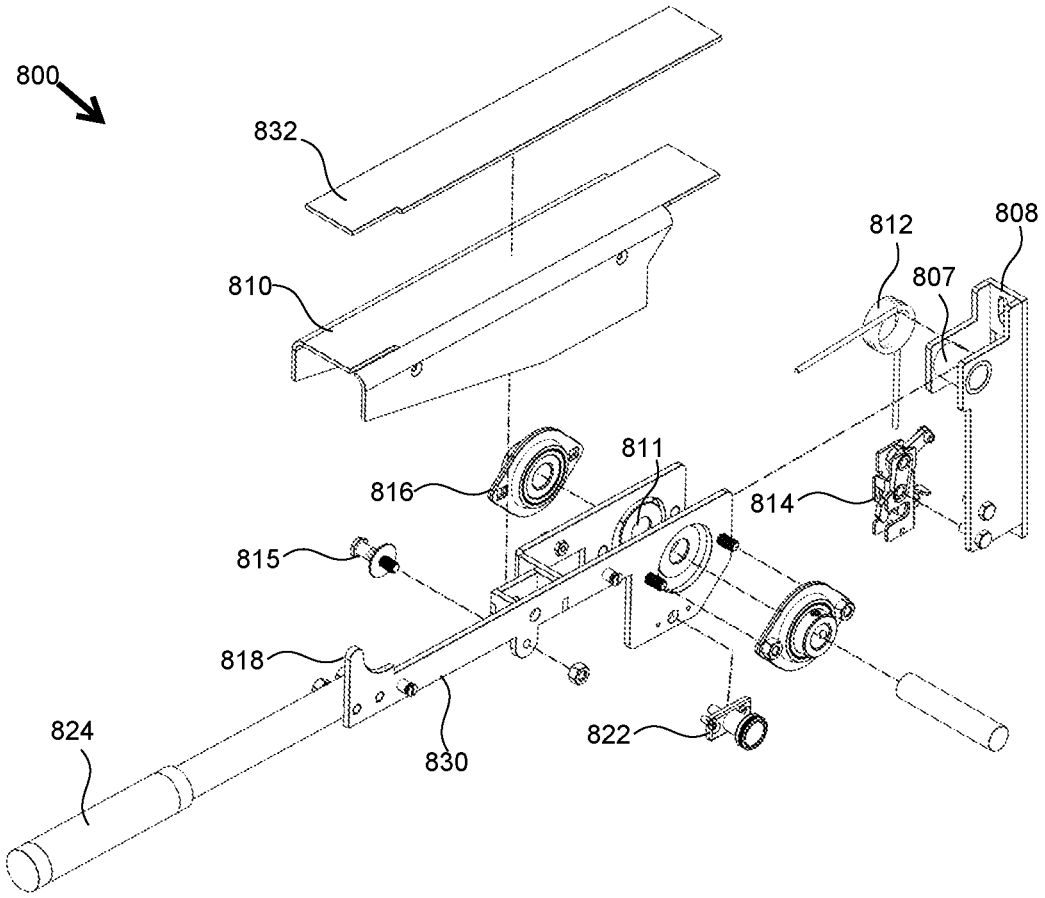
FIG. 8 is an exploded isometric view drawing showing an automatic spotting system.

FIG. 8 is an exploded isometric view drawing at 800 showing an automatic spotting system that may be used in one embodiment of the present invention. The mechanism of FIG. 8 is identical to that of FIG. 7 except that the piston and associated hardware is replaced by a torsion spring 812. The automatic spotting system 800 consists of a vertical support 808, a lifting bar 830, a handle 824, and a torsion spring 812. The latch actuating system is not shown at 800 but any actuation system discussed herein may be used. The vertical support 808 has a latch 814 and a slot 807 for a rotating joint 816. The lifting bar 830 has a hook 818, a cover 810 with padding 832, a latch pin 815, the rotating joint 816 that passes through a slot 811, and a locking pin 822. The vertical support 808 attaches to the bench press legs, in a manner similar to that shown in FIGS. 1 through 7.

In one embodiment, the bench 102 has a weight sensor that indicates a user is occupying the bench. This sensor sends a signal to the latch actuating mechanism indicating the system should be armed. This prevents the system from actuating without a user actually in place, as in a child playing around the machine.

The bench press is used by a user to lift a barbell carrying a weight. As the user lifts the barbell with the automatic spotting system 800 in the ready position (where the lifting bar 830 is parallel to the vertical support 808), the user engages the latch actuating system which sends a signal to the latch release mechanisms 814, which disengage the latch pins 815. With the latch pins 815 disengaged, the lifting bars 830 are pushed upwards by applied torque from torsion springs 812 until the lifting bars 830 reach the horizontal position. As the lifting bars 830 pass through the space occupied by the barbell, the hooks 818 catch the barbell and lift it with the lifting bars 830 to the horizontal, relieving the user of the weight of the barbell. As the lifting bars 830 reach the horizontal, the locking pins 822, a spring loaded pin, engage with the vertical supports 808, locking the lifting bars 830 in the horizontal and providing extra support for the barbell above that of the torsion springs 812.

The automatic spotting system 800 is readied by a user disengaging the locking pins 822 and using the handle 824 to push the lifting bars 830 to a parallel position with the vertical support 808, until the latch pins 815 engage the latch 814.

Figure 9:
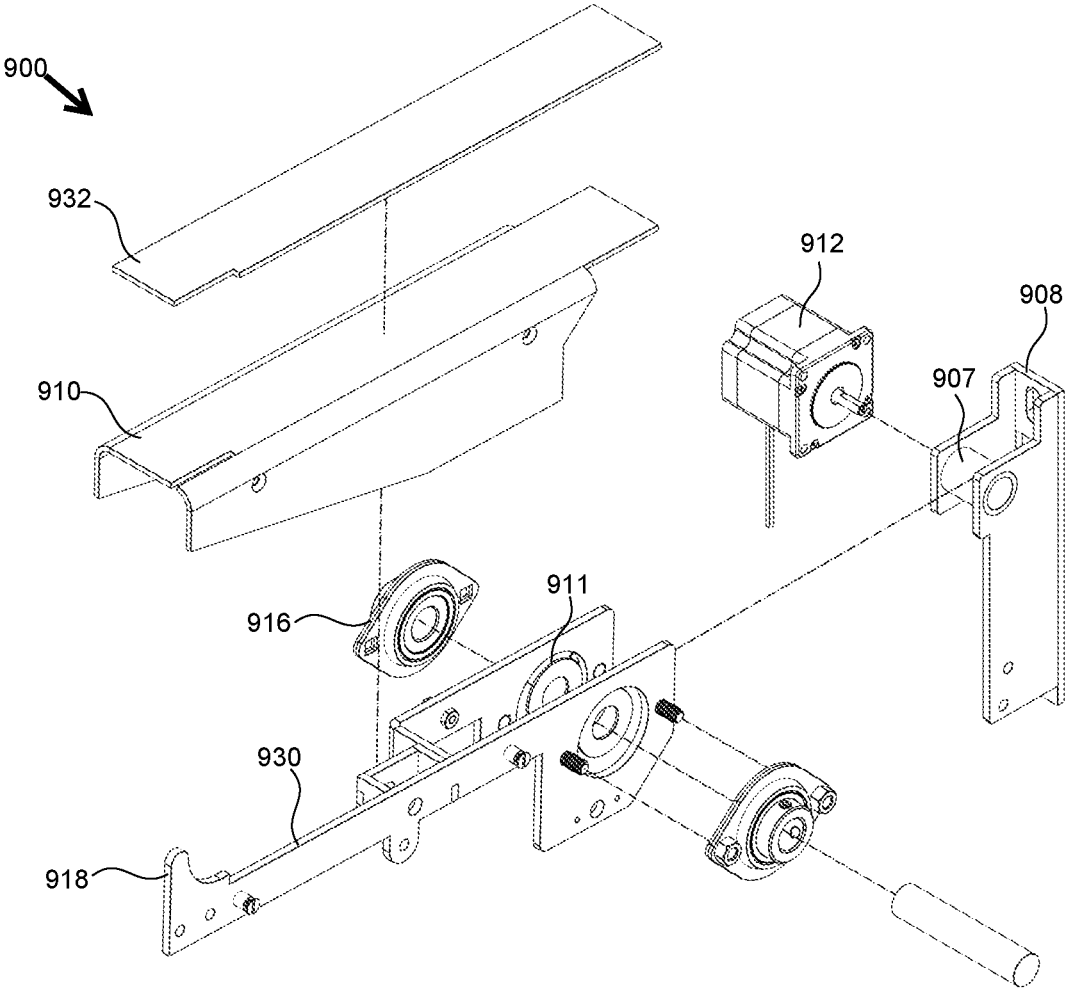
FIG. 9 is an exploded isometric view drawing showing an automatic spotting system.

FIG. 9 is an exploded isometric view drawing at 900 showing an automatic spotting system that may be used in one embodiment of the present invention. The mechanism of FIG. 9 is identical in function to that of FIG. 7 but with different mechanisms of function. The automatic spotting system 900 consists of a vertical support 908, a lifting bar 930, and a motor 912. Rather than a latch, a motor controller is utilized. The vertical support 908 has a slot 907 for a rotating joint 916. The lifting bar 930 has a hook 918, a cover 910 with padding 932 and the rotating joint 916 that passes through a slot 911. The vertical support 908 attaches to the bench press legs, in a manner similar to that shown in FIGS. 1 through 7.

The bench press is used by a user to lift a barbell carrying a weight. As the user lifts the barbell with the automatic spotting system 900 in the ready position (where the lifting bar 930 is parallel to the vertical support 908), the user engages the safety system (discussed below) which sends a signal to the motor 912 to lift the barbell. The motor 912 rapidly spins, rotating the rotating joint 916 and pushing the lifting bars 930 until the lifting bars 930 reach the horizontal position. As the lifting bars 930 pass through the space occupied by the barbell, the hooks 918 catch the barbell and lift it with the lifting bars 930 to the horizontal, relieving the user of the weight of the barbell. In a preferred embodiment, as the lifting bars 930 reach the horizontal, locking pins inside the motors 912 engage, locking the lifting bars 930 in the horizontal and providing extra support for the barbell above that of the motor 930.

The automatic spotting system 900 is readied by a user interacting with a motor controller that sends a signal to disengage the locking pins. The motor 912 then lowers the lifting bars 930 to a parallel position with the vertical support 908.

The safety system consists of a controller that operates the motor 912. The controller can be actuated by any of the other actuation devices mentioned herein, such as switches, causing the safety measures to begin.

Figure 10:
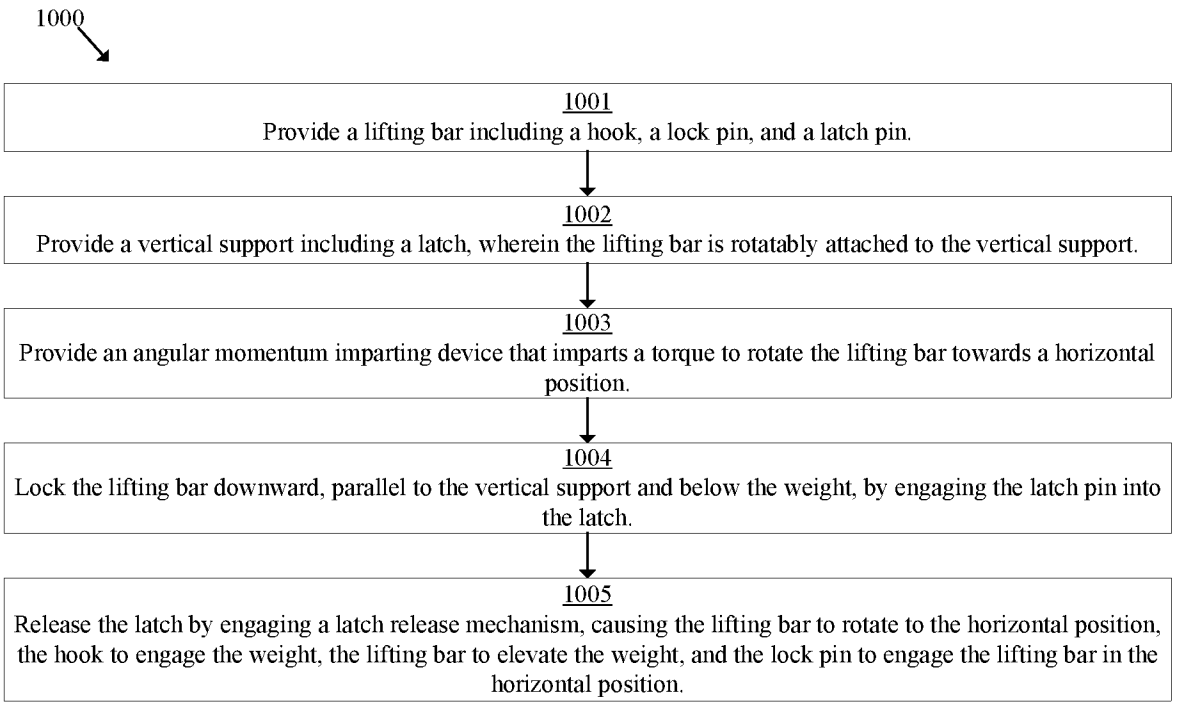
FIG. 10 is a block diagram showing a method for elevating a weight.

FIG. 10 is a block diagram showing a method at 1000 for elevating a weight that may be used in one embodiment of the present invention. At 1001, a lifting bar is provided including a hook, a lock pin, and a latch pin. At 1002, a vertical support is provided including a latch. The lifting bar is rotatably attached to the vertical support. At 1003, an angular momentum imparting device is provided and imparts a torque to rotate the lifting bar towards a horizontal position. At 1004, the lifting bar is locked downward, parallel to the vertical support and below the weight, by engaging the latch pin into the latch. At 1005, the latch is released by engaging a latch release mechanism, causing the lifting bar to rotate to the horizontal position, the hook to engage the weight, the lifting bar to elevate the weight, and the lock pin to engage the lifting bar in the horizontal position.

In one embodiment, the lock pin is spring actuated and the lock pin is disengaged by the user, allowing rotation of the rotating joint.

In a preferred embodiment, a lever arm is attached to the lifting bar, as in FIGS. 1 through 9, and is configured to provide the user sufficient leverage to overcome the torque of the angular momentum imparting device. In one embodiment, the lever arm is a handle that folds out to maximize the leverage. In another embodiment, the lever arm telescopes out to maximize the leverage.

In some embodiments, the angular momentum imparting device is a piston, a torsion spring, a counterweight, or a motor. In one embodiment, a motor is used to rotate the system back to the parallel position.

In one embodiment, the piston is attached by a first ball joint to the vertical support and by a second ball joint to the lifting bar. In an alternate embodiment, the piston is attached by a first hinge joint to the vertical support and by a second hinge joint to the lifting bar.

The latch release mechanism of safety mechanism may be actuated by the user pulling an ankle strap connected to a cable, by voice activation of a controller, by a foot pedal, by a camera and controller with situational recognition software, by a blood oxygen sensor, by a wireless button on the barbell, or by a combination thereof.

In a preferred embodiment, the arms are raised in a swinging motion via springs (such as gas springs or torsion springs) so as to be out of the way of the user until needed.

In a preferred embodiment, the arms are activated via a cable system that attaches to the user's ankle via a cuff. When the user kicks, the cables are pulled and activate a latch to unlock the arms from the passive position. In another embodiment, the cable system attaches to a lever or button that is pressed by the user's feet.

In a preferred embodiment, the arms are held in the upright position using a pin so as to keep the arm from falling back down when loaded with weight and the user is not aiding the arms. This could be accomplished by similar means such as a ratcheting system or locking gas spring. In the case of a motor, the motor can have an internal locking pin.

The drawings herein show a flat bench press. However, the present invention can be used on an inclined bench, a declined bench, squat rack, preacher curl bench, or other weight lifting systems where the person is under a weight carried by a bar.

The invention has been described with reference to various specific and preferred embodiments and techniques. Nevertheless, it is understood that many variations and modifications may be made while remaining within the spirit and scope of the invention.

What is claimed is:

1. A system for elevating a weight comprising:

a vertical support comprising:

a first slot configured to engage a rotating joint; and a latch configured to hold a latch pin;

a latch release mechanism configured to release the latch pin from the latch;

a rotating joint that rotatably attaches a lifting bar to the vertical support;

the lifting bar comprising:

a hook configured to capture and hold the weight when the rotating joint moves the lifting bar to a horizontal position, perpendicular to the vertical support;

a lock pin configured to engage the vertical support when the rotating joint moves the lifting bar to the horizontal position;

a latch pin configured to engage the latch when the rotating joint lowers the lifting bar to a parallel position with the vertical support;

a second slot configured to engage the rotating joint; and an angular momentum imparting device configured to continuously impart a torque to rotate the lifting bar towards the horizontal position;

wherein the lifting bar is configured to be rotated downward by a user to engage the latch pin with the latch, thereby latching the lifting bar down;

wherein the latch is released by the latch release mechanism, allowing the angular momentum imparting device to rotate the lifting bar to the horizontal position, the hook engaging and lifting the weight; and wherein the lock pin engages and locks the lifting bar in the horizontal position.

2. The system of claim 1, wherein the lock pin is spring actuated and the lock pin is configured to be disengaged by the user, allowing rotation of the rotating joint.

3. The system of claim 1, further comprising a lever arm attached to the lifting bar and configured to provide the user sufficient leverage to overcome the torque of the angular momentum imparting device.

4. The system of claim 3, wherein the lever arm comprises a handle that folds out or telescopes out to maximize the leverage.

5. The system of claim 1, wherein the angular momentum imparting device comprises a piston, a torsion spring, a counterweight, or a motor.

6. The system of claim 5, wherein the piston is attached by a first ball joint to the vertical support and by a second ball joint to the lifting bar.

7. The system of claim 5, wherein the piston is attached by a first hinge joint to the vertical support and by a second hinge joint to the lifting bar.

8. The system of claim 1, wherein two of the systems are provided to a bench press, the weight is a barbell, and the latch release mechanism is configured to be actuated by the user to lift the barbell for the user.

9. The system of claim 1, wherein the latch release mechanism is configured to be actuated by the user pulling an ankle strap connected to a cable by voice activation of a controller, by a foot pedal, by a camera and controller with situational recognition software, by a blood oxygen sensor, by a wireless button on the barbell, or by a combination thereof.

10. The system of claim 1, wherein two of the systems are provided to a squat rack or preacher curl bench, the weight is a barbell or other bar carrying weight, and the latch release mechanism is configured to be actuated by the user to lift the barbell for the user.

11. A method for elevating a weight comprising:

providing a lifting bar comprising a hook, a lock pin, and a latch pin;

providing a vertical support comprising a latch;

wherein the lifting bar is rotatably attached to the vertical support;

providing an angular momentum imparting device that imparts a torque to rotate the lifting bar towards a horizontal position;

locking the lifting bar downward, parallel to the vertical support and below the weight, by engaging the latch pin into the latch;

releasing the latch by engaging a latch release mechanism, causing the lifting bar to rotate to the horizontal position, the hook to engage the weight, the lifting bar to elevate the weight, and the lock pin to engage the lifting bar in the horizontal position.

12. The method of claim 11, wherein the lock pin is spring actuated and further comprising the user disengaging the lock pin, allowing rotation of the rotating joint.

13. The method of claim 11, further comprising providing a lever arm attached to the lifting bar of sufficient length so that the user can apply a downward force that overcomes the torque of the angular momentum imparting device.

14. The method of claim 13, wherein the lever arm comprises a handle that folds out or telescopes out to provide the sufficient length.

15. The method of claim 11, wherein the angular momentum imparting device comprises a piston, a torsion spring, a counterweight, or a motor.

16. The method of claim 15, wherein the piston is attached by a first ball joint to the vertical support and by a second ball joint to the lifting bar.

17. The method of claim 15, wherein the piston is attached by a first hinge joint to the vertical support and by a second hinge joint to the lifting bar.

18. The method of claim 11, further comprising providing two of the systems to a bench press, wherein a user lifts a barbell and actuates the latch release mechanism to lift the barbell for the user.

19. The method of claim 11, further comprising actuating the latch release mechanism by a user pulling an ankle strap connected to a cable by voice activation of a controller, by a foot pedal, by a camera and controller with situational recognition software, by a blood oxygen sensor, by a wireless button on the barbell, or by a combination thereof.

20. A system for elevating a weight comprising:

a vertical support comprising a first slot configured to engage a rotating joint;

a lifting bar comprising:

a hook configured to capture and hold the weight when the rotating joint moves the lifting bar to a horizontal position, perpendicular to the vertical support; and a second slot configured to engage the rotating joint;

the rotating joint configured to allow the lifting bar to rotate relative to the vertical support; and a motor configured to rotate the lifting bar downward when the motor receives instructions from the user and to impart angular momentum to rotate the lifting bar to the horizontal position when a safety switch engages;

wherein as the safety switch engages, the motor rotates the lifting bar to the horizontal position, the hook engaging and lifting the weight.

* * * * *